US005823325A

United States Patent [19]

Lin

[11] Patent Number: 5,823,325

[45] Date of Patent: Oct. 20, 1998

[54] KEYSWITCH ASSEMBLY FOR A MULTIPLE-WIDTH KEY

[76] Inventor: San-Feng Lin, c/o Acer Peripherals Inc., No. 157, Shan-Ying Road, Kweishan, Taoyuan, Taiwan

[21] Appl. No.: 965,215

[22] Filed: Nov. 6, 1997

[30] Foreign Application Priority Data

Aug. 1, 1997 [TW] Taiwan ..... 86213030

[51] Int. Cl.[6] ..... H01H 13/70

[52] U.S. Cl. ..... 200/344

[58] Field of Search ..... 200/5 A, 512, 200/517, 341, 344, 345; 400/472, 490, 491, 491.2, 495, 495.1, 496

[56] References Cited

U.S. PATENT DOCUMENTS 4,475,832 10/1984 Wachs ..... 400/496
4,771,146 9/1988 Suzuki et al. ..... 200/340
4,830,526 5/1989 Hosono ..... 400/490
5,376,765 12/1994 Holmes et al. ..... 200/344
5,668,358 9/1997 Wolf et al. ..... 200/5 A
5,669,723 9/1997 Chang ..... 400/496

*Primary Examiner*—Michael A. Friedhofer
*Attorney, Agent, or Firm*—Proskauer Rose LLP

[57] ABSTRACT

An improved multiple-width keyswitch having a balance lever is provided. The balance lever has a longitudinal portion and a pair of traverse portions which are respectively perpendicular to the longitudinal portion such that a substantial U-shape configuration is formed. The traverse portions are respectively inserted into a mounting lug of a substrate. The traverse portions of the balance lever are respectively sleeved with a tubular bushing. One end of the tubular bushing is biased against to the mounting lug such that the horizontal displacement of the keycap with respect to the substrate can be reduced or eliminated.

8 Claims, 3 Drawing Sheets

KEYSWITCH ASSEMBLY FOR A MULTIPLE-WIDTH KEY

FIELD OF THE INVENTION

The present invention relates to a keyswitch and, more particularly, to an improved keyswitch assembly for a multiple-width key on a computer keyboard.

DESCRIPTION OF PRIOR ART

The keyswitch having a scissors-type reciprocating mechanism has been widely utilized in computer keyboard due to its feature of compactness. Details regarding the scissors-type keyswitch have been disclosed in the U.S. Pat. Nos. 5,512,719; 5,457,297; 4,433,225; 4,580,022; 4,902,862; 5,280,147; 5,329,084; 5,382,762; 5,399,822; 5,463,195; 5,466,901; 5,504,283; 5,519,569; 5,512,719; 5,278,371; 5,278,372; and 5,278,374. Furthermore, Taiwan Utility Patent No. 237,991 entitled "Bridge-type Keyswitch", Patent No. 282,857 "Keyswitch Mechanism Of Keyboard", and Patent No. 286,794 "Button Switch" also disclose the keyswitch of same type. U.S. Ser. No. 08/758,686, entitled "Push Button Switch having Scissors-type Arm Member", which is invented by identical inventor and assigned to the identical assignee of this application, also discloses a scissors-type keyswitch.

Typically, a keyboard consists of a plurality of keys most of which are in square shape. However, there are some keys which have a longer dimension, such as the "ENTER", "SPACE BAR", and "SHIFT" keys. These special keys are usually referred to as the multiple-width key.

Taking the multiple-width keys which employs the scissors-type keyswitch as an example, it generally includes a keycap, an internal arm, an external arm, a resilient dome, a membrane switch, and a substrate. The internal and external arms are pivotally assembled to each other such that the scissors-type reciprocating mechanism is constituted. The substrate includes a main planar surface on which a receiving groove and a connecting portion are respectively and integrally formed. The keycap has a bottom surface with a pair of first retaining portions which are spaced from each other. A pair of second retaining portions, which are spaced from each other, are also formed on the bottom surface of the keycap. The internal arm is provided with a first shaft at a first end which is pivotally disposed between the pair of the first retaining portions of the keycap. The internal arm is further provided with a second shaft at a second end which is slidably and rotatably received within the bearing portion of the substrate. The external arm is provided with a projected boss which is slidably and rotatably received within a corresponding receiving groove of the substrate.

In addition to the above mentioned components, the conventional multiple-width key further includes a balance lever. Since the keycap of the multiple-width key has a longer longitudinal dimension, and as the balance lever is not provided, the keycap will become inclined relative to the horizontal plane if the depressing force is not applied at the middle portion of the keycap. As a balance lever is employed, the keycap is always kept horizontally during its reciprocating movement regardless of the locations at which the depressing force is applied.

However, to assemble the above mentioned components, dimension tolerance must be provided. Nevertheless, the provided tolerance between different components creates undesired movement or swing of the keycap relative to the horizontal surface. As a result, during the operation of the multiple-width keys, noise due to the horizontal movement of the keycap is generated.

SUMMARY OF THE INVENTION

It is the objective of this invention to provide a multiple-width keyswitch which substantially reduces the operation noise due to the horizontal movement of the keycap.

The improved keyswitch includes a keycap, a substrate, a reciprocating mechanism, a resilient dome, a membrane switch and a balance level.

The keycap defines a top surface and a bottom surface which is provided with a connecting portion and a pair of retaining tabs which define a retaining groove.

The substrate has a connecting portion and a pair of mounting lugs. The reciprocating mechanism has an upper end pivotally engaged to the connecting portion of the keycap and has a lower end pivotally engaged with the connecting portion of the substrate such that the keycap is capable of moving downward when the keycap is depressed, and moving upward and away from the substrate when the depress force is released.

The balance lever has a longitudinal portion and a pair of traverse portions which are respectively perpendicular to the longitudinal portion such that a substantial U-shape is formed. The traverse portions are respectively inserted into the mounting lugs of the substrate, and the longitudinal portion is received within the retaining groove of the keycap. The traverse portions of the balance lever are respectively sleeved with a tubular bushing, and one end of the tubular bushing is biased against to the mounting lug such that the horizontal displacement of the keycap with respect to the substrate can be reduced or eliminated.

BRIEF DESCRIPTION OF DRAWINGS

The present invention may readily be understood by the following descriptions together with the accompanying drawings, in which.

DETAILED DESCRIPTION OF PREFERRED EMBODIMENT

Figure 1:
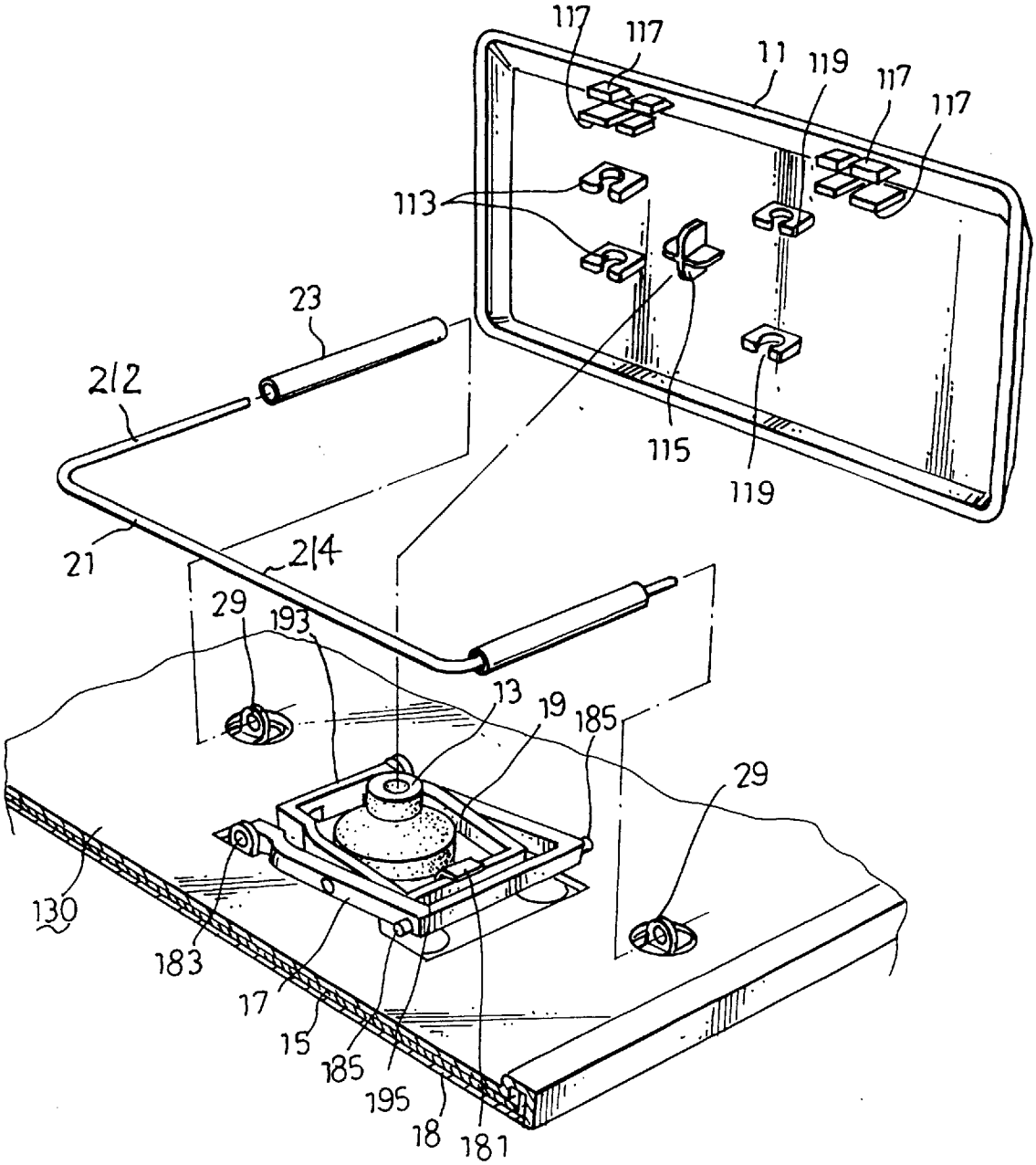
FIG. 1 is an exploded perspective view of the multiple-width-keyswitch according to the present invention.

Referring to FIG. 1, the multiple-width keyswitch of the invention generally includes a keycap 11, an internal arm 19, an external arm 17, a resilient dome 13, a membrane switch 15, a balance lever 21 and a substrate 18.

A pair of mounting lugs 29, a pair of receiving lugs 183, and a bearing portion 181 which exhibits a L-shape is integrally formed with the substrate 18. The receiving lugs 183 and the bearing portion 181 together define a connecting portion of the substrate 18. The resilient dome 13 is integrally formed with a resilient membrane 130.

The keycap 11 defines a bottom surface thereof. The bottom surface is provided with a pair of retaining tabs 117, a pair of first retaining lugs 113, and a pair of second retaining lugs 119. The first and second retaining lugs 113 and 119 together define the connecting portion of the keycap 11 for engaging with the internal arm 19 and external arm 17.

The internal arm 19 and the external arm 17 are pivotally assembled together such that a scissors-type reciprocating mechanism for the keyswitch is formed. One upper end of the reciprocating mechanism is inserted within the connecting portion of the keycap 11 and one lower end of the reciprocating mechanism is inserted within the receiving lug 183 of the substrate 18. By this arrangement, the keycap 11 moves vertically toward or away from the substrate 18 due to action of the reciprocating mechanism constituted by the internal and external arms 19, 17. The internal arm 19 is provided with a first shaft 193 at a first end which is pivotally attached to first retaining lugs 113. The internal arm 19 is further provided with a second shaft 195 at a second end which is slidably and rotatably received within the bearing portion 181 of the substrate 18. The external arm 17 is provided with a pair of bosses at a first end which are respectively slidably and rotatably received within one of the corresponding receiving lugs 183 of the substrate 18. The external arm 17 is provided with a pair of bosses 185 at a second end which are respectively slidably and rotatably disposed within the second retaining lugs 119 of the keycap 11.

When assembled, the engagement portion 115 of the keycap is inserted and retained within the corresponding hole of the resilient dome 13. The membrane switch 15 is ON when the keycap 11 is depressed downward and OFF when the keycap 11 bounces back. The balance lever 21 includes a longitudinal portion 214 and a pair of traverse portions 212, which are respectively perpendicular to the longitudinal portion 214, to form an U-shape configuration. Each of the transverse portions 212 of the balance lever 21 can be inserted and retained within one corresponding mounting lug 29 of the substrate 18, and the longitudinal portion 214 of the balance lever 21 is received and retained within the retaining groove defined by the retaining tabs 117.

In order to solve the drawback encountered by the conventional approach, a tubular resilient bushing 23 having a passage is provided. The diameter of the passage of the tubular bushing 23 is equal to or slightly smaller than the outer diameter of the longitudinal portion 214 of the balance lever 21.

Before the traverse portions 212 of the balance lever 21 are respectively mounted into the mounting lugs 29, the tubular bushing 23 is firstly sleeved into the traverse portions 212 of the balance lever 21. The tubular bushing 23 shown at the left hand side of FIG. 1 is the status before assembly, and the tubular bushing 23 shown at the right hand side of FIG. 1 is the status after assembly. Afterward, each traverse portion 212 of the balance lever 21 is inserted into the mounting lug 29. After the mounting of the balance lever 21 is completed, the keycap 11 then engages with the resilient dome 13, the internal arm 19, the external arm 17 and the balance lever 21. In particular, the engagement portion 115 of the keycap 11 is aligned and inserted into the corresponding hole of the resilient dome 13. The first shaft 193 of the internal arm 19 is received and retained within the first retaining lugs 113, the boss 185 of the external arm 17 is slidably and rotatably received and retained within the second retaining lugs 119, and the longitudinal portion 214 of the balance lever 21 is received within the retaining groove defined by the retaining tabs 117. After those components are sequentially assembled, the interrelationship between them is shown in FIG. 2.

Figure 2:
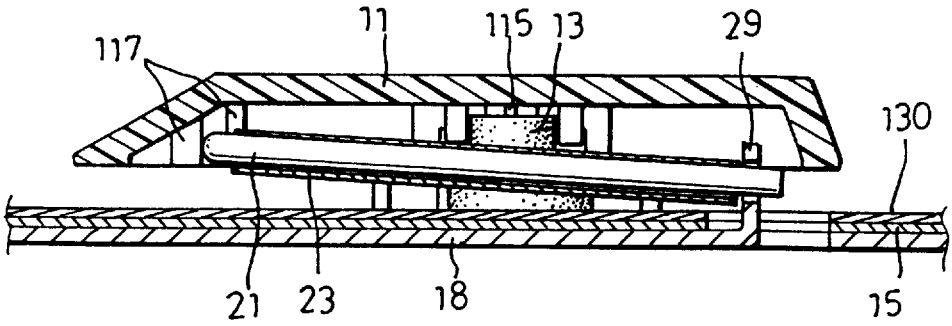
FIG. 2 is a cross sectional view of the multiple-width keyswitch shown in FIG. 1 after assembly.

As shown in FIG. 2, one end of the tubular bushing 23 is biased against to the mounting lug 29 of the substrate 18, and by this arrangement, the horizontal movement or displacement of the keycap 11 with respective to the substrate 18 can be effectively reduced or eliminated by the cooperation of the balance lever 21 and the tubular bushing 23. As a result, the horizontally swing or movement of the keycap 11 can be effectively eliminated and the noise generated therefrom is also eliminated.

Figure 4:
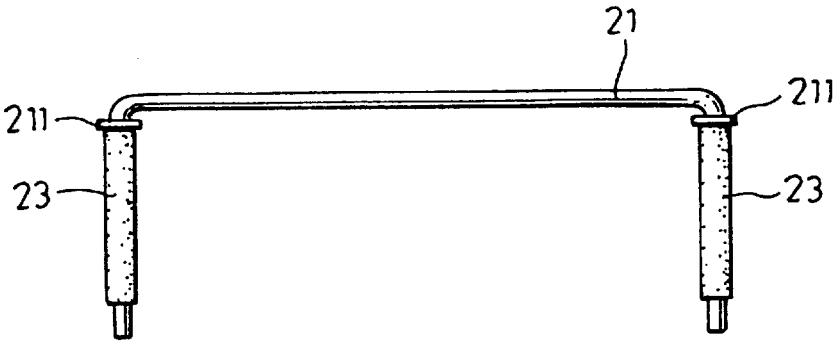
FIG. 4 shows the relationship between the balance lever and the resilient tubular bushing in a second embodiment.

The interrelationship between the tubular bushing 23 and the balance lever 21 can be arranged in the following three embodiments. 1) One end of the tubular bushing 23 is positioned at the junction between the longitudinal portion 214 and the traverse portion 212 of the balance lever 21, as shown in FIG. 1; 2) one end of the tubular bushing 23 is biased against to a protrusion 211 located at a location along the traverse portion 212 of the balance lever 21, as shown in FIG. 4; and 3) as the inner diameter of the passage of the tubular bushing 23 is smaller than the outer diameter of the traverse portion 212 of the balance lever 21, the tubular bushing 23 exerts a radial tighten force around the traverse portion 212 of the balance lever 21.

Although the tubular bushing 23 is provided in the invention, the freedom of movement of the traverse portion 212 of the balance lever 21 along and within the hole of the mounting lug 29 is not impaired. As a result, when the keycap 11 moves downward or bounces upward, the conventional function provided by the balance lever 23, which is performed by a small angular movement of the balance lever 23 relative to the center of the hole of the mounting lug 29, is still retained.

Figure 3:
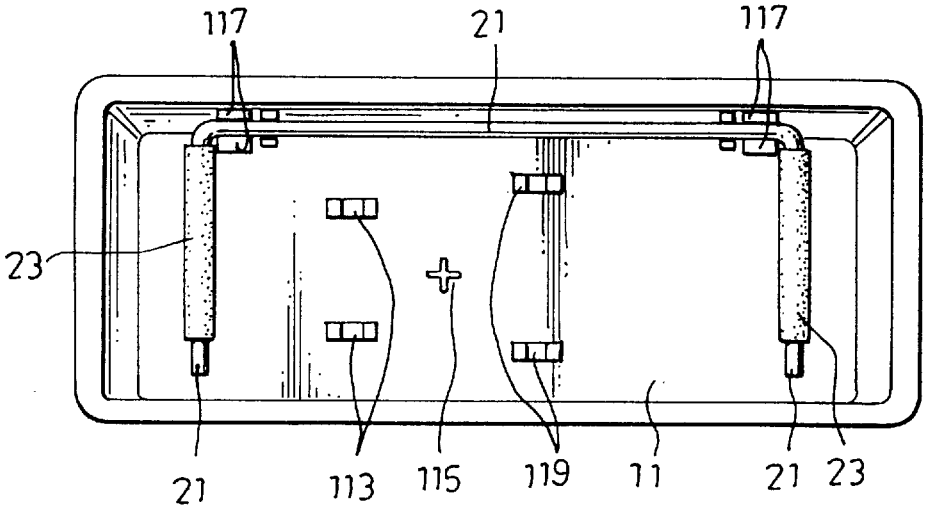
FIG. 3 shows the interrelationship between the keycap, the balance lever and the resilient tubular bushing when assembled.
Figure 5:
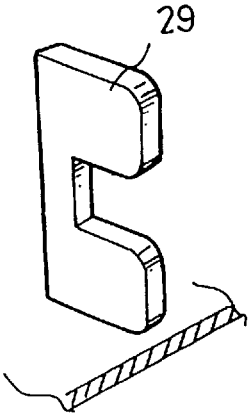
FIG. 5 is a second embodiment of the mounting lug.

FIG. 3 discloses the interrelationship between the connecting portion of the keycap 11 and the balance lever 21. Generally, the mounting lug 29 can be so configured as to receive the transverse portion 212 of the balance lever 21. Therefore, the mounting lug 29 can be configured as an U-shape lug having a channel, as shown in FIG. 5, for receiving the transverse portion 212 of the balance lever 21.

Figure 6:
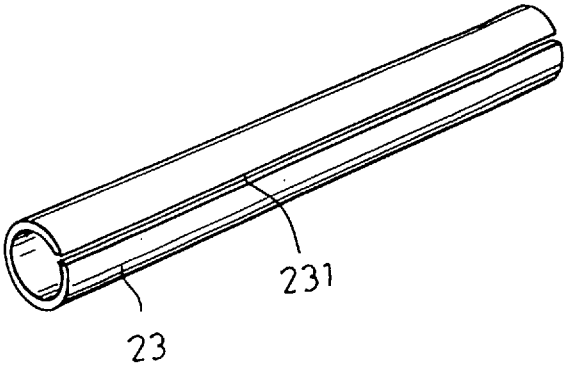
FIG. 6 is a second embodiment of the resilient tubular bushing.

FIG. 6 is another embodiment of the tubular bushing 23 which is provided with a lengthwise slit which, when split by force, allows easy insertion of the traverse portion 212 of the balance lever 21 into the passage of the tubular bushing 23.

While specific embodiment of the present invention has been illustrated and described, it would be obvious to those skilled in the art that various equivalent changes or modifications can be made without departing from the spirit and scope of the invention which is defined in the following claims.

What is claimed is:

1. An improved keyswitch assembly, comprising:

a keycap defining a top surface and a bottom surface, said bottom surface being provided with a connecting portion and a pair of retaining tabs which define a retaining groove therebetween;

a substrate having a connecting portion and a pair of mounting lugs thereof;

a reciprocating means having an upper end pivotally engaged to said connecting portion of said keycap and having a lower end pivotally engaged with said connecting portion of said substrate such that said keycap is capable of moving downward with respect to said substrate when said keycap is depressed by an external force, and moving upward and away from said substrate when the external force is released;

a switch which, responsive to the movement of the keycap, is selectively turned ON;

a balance lever having a longitudinal portion and a pair of traverse portions which are respectively perpendicular to said longitudinal portion such that a substantial U-shape configuration is formed, wherein said traverse portions are respectively inserted into said mounting lugs of said substrate, and said longitudinal portion is received within said retaining groove;

wherein said traverse portions of said balance lever are respectively sleeved with a tubular bushing, and one end of said tubular bushing being biased against said mounting lug such that the horizontal displacement of said keycap with respect to said substrate can be reduced or eliminated.

2. The improved keyswitch assembly as recited in claim 1, wherein said reciprocating means is constituted by an internal arm and an external arm to form a scissors-type mechanism.

3. The improved keyswitch assembly as recited in claim 1, wherein another end of said tubular bushing is positioned at a junction between said longitudinal portion and said traverse portion of said balance lever.

4. The improved keyswitch assembly as recited in claim 1, wherein another end of said tubular bushing is positioned at a protrusion located at a location along said traverse portion of said balance lever.

5. The improved keyswitch assembly as recited in claim 1, wherein said tubular bushing exerts a radial tightening force around said traverse portion of said balance lever.

6. The improved keyswitch assembly as recited in claim 1, wherein said mounting lug of said substrate has a mounting hole.

7. The improved keyswitch assembly as recited in claim 1, wherein said mounting lug of said substrate has an open mounting channel.

8. The improved keyswitch assembly as recited in claim 1, wherein said tubular bushing is provided with a lengthwise slit which, when split by force, allows easy insertion of said traverse portion of said balance lever into a passage of the tubular bushing.

* * * * *